US008629778B2

(12) United States Patent
Burrow

(10) Patent No.: US 8,629,778 B2
(45) Date of Patent: Jan. 14, 2014

(54) FUEL USAGE MONITORING

(75) Inventor: Christopher James Burrow, Williamson, GA (US)

(73) Assignee: Southern Company Services, Inc., Atlanta, GA (US)

( * ) Notice: Subject to any disclaimer, the term of this patent is extended or adjusted under 35 U.S.C. 154(b) by 393 days.

(21) Appl. No.: 12/947,046

(22) Filed: Nov. 16, 2010

(65) Prior Publication Data

US 2012/0119916 A1 May 17, 2012

(51) Int. Cl.
*G08B 21/00* (2006.01)

(52) U.S. Cl.
USPC ..... 340/612; 340/680; 340/693.3

(58) Field of Classification Search
USPC ..... 340/612, 618, 623, 625, 632, 636.1, 340/636.19, 641–642, 679–680, 340/693.1–693.2, 693.3
See application file for complete search history.

(56) References Cited

U.S. PATENT DOCUMENTS

| | | | | |
|---|---|---|---|---|
| 6,141,194 | A * | 10/2000 | Maier | 361/58 |
| 7,748,416 | B2 * | 7/2010 | Bender et al. | 141/95 |
| 2003/0167105 | A1 * | 9/2003 | Colborn | 700/295 |
| 2004/0164618 | A1 * | 8/2004 | Bryde | 307/64 |
| 2008/0313006 | A1 * | 12/2008 | Witter et al. | 705/9 |
| 2009/0046415 | A1 * | 2/2009 | Rasmussen et al. | 361/644 |

* cited by examiner

*Primary Examiner* — Daniel Previl
(74) *Attorney, Agent, or Firm* — Thomas Horstemeyer LLP

(57) ABSTRACT

Various methods and systems are provided for monitoring fuel usage and/or remaining run time of backup power sources. In one embodiment, a method includes tracking run time of a backup power source; determining a current fuel level associated with the backup power source; and providing a fuel level warning. In another embodiment, a system includes a fuel monitoring system including logic that obtains a current run time corresponding to a backup power source; logic that determines a current fuel level based at least in part upon the current run time, the current fuel level corresponding to a fuel source supplying the backup power source; and logic that provides a fuel level warning based upon the current fuel level and a predefined fuel level threshold.

20 Claims, 5 Drawing Sheets

600

| | Report Time | Site Description | Fuel Level | Remaining Run Time | ... |
|---|---|---|---|---|---|
| 1 | 3-9-10 12:10 | Mountain View | 18.80 % | 21.77 HRS | ... |
| 2 | 3-9-10 12:05 | Lakefront | 46.20 % | 23.63 HRS | ... |
| 3 | 3-9-10 12:20 | Twin Bluffs | 32.00 % | 11.86 HRS | ... |
| ⋮ | ⋮ | ⋮ | ⋮ | ⋮ | |

FUEL USAGE MONITORING

BACKGROUND

Backup systems are commonly used in remote locations to provide backup power sources when the primary power supply is lost due to system failure, inclement weather, or other emergencies. These backup systems generally include fuel sources such as fuel tanks to ensure system operation when the need arises.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
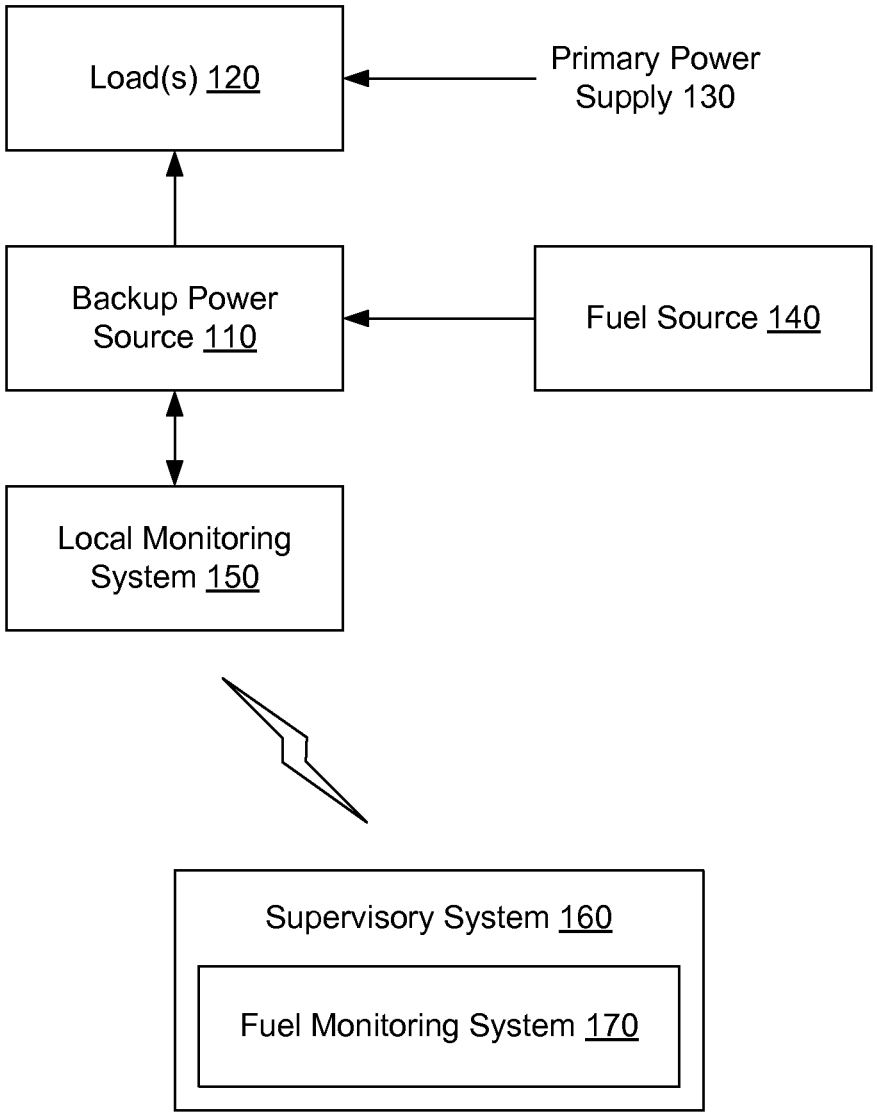
FIG. 1 is a block diagram illustrating monitoring of a backup power source according to various embodiments of the present disclosure.

Disclosed herein are various embodiments of systems and methods related to monitoring fuel usage and/or remaining run time of backup power sources. Reference will now be made in detail to the description of the embodiments as illustrated in the drawings, wherein like reference numbers indicate like parts throughout the several views.

Referring to FIG. 1, shown is an example of a backup power source 110 such as, but not limited to, a backup generator, fuel cell, or other energy conversion unit that utilizes a source of fuel. Backup power sources 110 allow for continued operation of one or more loads 120 such as computing systems, telecommunication infrastructure, and other applications that may be remotely located. Backup power sources 110 supply backup power when the primary power supply 130 (e.g., through an electrical power distribution system) is not online. This can occur during routine outages and/or disaster recovery events such as, for example, fallen trees or limbs, hurricanes, tornados, electrical storms, winter storms, etc. In many situations, continued operation of remotely located units is vital to effective disaster recovery. For example, maintaining communications during a power outage can facilitate coordination of repair crews, thereby reducing the outage impact. Monitoring fuel levels in fuel tanks of backup generators can be very important during disaster recovery operations to ensure continuous operation of communication and control equipment during the restoration process. A backup power source 110 running out of fuel unexpectedly can prolong the recovery.

As illustrated in FIG. 1, the backup power source 110 receives fuel from a fuel source 140 such as, e.g., a fuel tank or other fuel storage container. In the embodiment of FIG. 1, a single backup power source 110 is being supplied from the fuel source 140. In some embodiments, a plurality of backup power sources 110 may receive fuel from the same fuel source 140. Local monitoring system 150 can be used to monitor the operation of the backup power source 110. For example, the local monitoring system 150 can detect start up, running, and shut down of the backup power source 110. The local monitoring system 150 may also track other operating characteristics of the backup power source. In some embodiments, the local monitoring 150 also provides for control of the backup power source 110 operation.

Upon start up of the backup power source 110, the local monitoring system 150 communicates a start indication to a supervisory system 160. For example, a "generator run" alarm may be sent by the local monitoring system 150 to the supervisory system 160. The supervisory system 160 determines the start time and begins tracking the run time of the backup power source. Information such as start and stop indications, alarms, and other operational data can be communicated between the local monitoring system 150 and the supervisory system 160 wirelessly or over a hardwire connection. For example, the information can be transmitted wirelessly using cellular telephone, radio frequency, or another appropriate wireless communication method. The information may also be communicated using analog or digital communication on a hardwire connection.

The supervisory system 160 can include a data store (e.g., data store 723 of FIG. 7) where historical data associated with the operation of the backup power source 110 (e.g., start times, stop times, and/or run times of the backup power source 110) can be stored and updated. The data store may also include information about the fuel source 140 of the backup power source 110. For example, the data store may include the fuel level of the fuel source 140, as well as previous fill history information. In other embodiments, the data store may be remotely located from and accessible by the supervisory system 160.

The supervisory system 160 also comprises a fuel monitoring system 170, which may be initiated in response to the start indication. The fuel monitoring system 170 may also be initiated in response to a user request or based upon other predefined conditions such as, but not limited to, the expiration of a predefined time interval or a preset time each day. The fuel monitoring system 170 obtains a current run time for the backup power source 110. For example, the current run time may be the accumulated run time from the last refueling of the fuel source 140. In some embodiments, the current run time may be obtained from the data store, which may be accessed and/or updated by the supervisory system 160 and/or by the fuel monitoring system 170. In alternative embodiments, the current run time may be determined from the time of the start indication.

The fuel monitoring system 170 may then determine the current fuel level in the fuel source 140. The current fuel level may be based, at least in part, upon the current run time. In one embodiment, a fuel usage rate of the backup power source 110 is used to determine the current fuel level. For example, the fuel usage rate may be the rate at which the backup power source 110 uses fuel when operating at a fixed load level, e.g., 75% of full load. The fuel usage rate may be based upon, e.g., manufacturer data for the backup power source 110 or measurements taken during operation of the backup power source 110. The current fuel tank level may be determined by adjusting a starting fuel tank level by the amount of fuel used during the current run time, i.e., current fuel tank level=starting fuel tank level−(fuel usage rate×current run time). If the current run time is the accumulated run time from the last refueling of the fuel source 140, then the starting fuel tank level is the final level after fueling. In alternative embodiments, the starting fuel tank level may be the fuel tank level prior to beginning operation of the backup power source 110. In that case, the current run time is the time from the start indication. The fuel tank levels may be defined in terms of volume (e.g., gallons, liters, etc.) or percentage of the full volume of the fuel source 140 (e.g., % of a full tank).

The current fuel level may also be determined based upon a remaining run time for the backup power source 110. A run time capacity may be determined based upon how long the backup power source 110 would operate at a fixed load level. Given an initial amount of fuel (e.g., 80% of a full tank) and the fuel usage rate when the backup power source 110 operates at a fixed load level (e.g., 75% of full load), the run time capacity associated with the backup power source 110 can be calculated. The run time capacity may be stored in the data store for later retrieval by the fuel monitor system 170. A remaining run time for the backup power source 110 can be readily determined based upon the current run time, i.e., remaining run time=run time capacity−current run time. The current fuel level for the fuel source 140 can be determined based upon the initial amount of fuel. For example, where the initial amount is 80% of a full tank (i.e., 0.8), current fuel level (in percent)=[remaining run time/(run time capacity/0.8)]×100.

A fuel level warning may be provided by the fuel monitoring system 170 and/or the supervisory system 160 based upon the current fuel level and a predefined fuel threshold. For example, if the current fuel level drops below a predefined percentage or volume of the fuel source 140, then a fuel level warning is provided. In one embodiment, the fuel threshold is 40% of a full tank. In some embodiments, multiple fuel thresholds may be utilized, each providing a different level of warning. The threshold values may be stored in a data store of the supervisory system 160.

The fuel level warning may be an alarm that is issued by the supervisory system 160 to notify an operator of the status of the fuel source 140. In response to the fuel level warning, a refill request is submitted to a fuel supplier to refill the fuel source 140. In some embodiments, a notification screen may be generated for rendering on a display device (e.g., 713 of FIG. 7). The refill request may be generated based upon user inputs to the notification screen. In alternative embodiments, a refill request may be automatically generated by the fuel monitoring system 170 and, in some cases, transmitted to a fuel supplier for action. In some embodiments, the refill request is remotely generated in response to indications received from the fuel management system 170 and/or the supervisory system 160. Once the fuel source 110 is refilled, the current run time is reset to zero and the starting tank level is adjusted to match the actual tank level. The refill request may then be closed out and billing by the vendor may be confirmed.

Determination of the current fuel level may be periodically repeated by the fuel monitoring system 170 during operation of the backup power source 110. For example, the current fuel level may be updated at predetermined time intervals (e.g., every 30 minutes, every 15 minutes, every 10 minutes, every 5 minutes, etc.) during operation of the backup power source 110. In other embodiments, the determination period of the current fuel level may vary based upon other factors such as, but not limited to, load level, weather factors, and time of day.

Upon shut down of the backup power source 110, the local monitoring system 150 communicates a stop indication to the supervisory system 160. When a stop indication is received, the fuel monitoring system 170 determines the current run time accumulated up to the time of shut down and the current fuel level in the fuel source 140 at the time of shut down. The run time and fuel level may then be stored in the data store for later retrieval.

Figure 2:
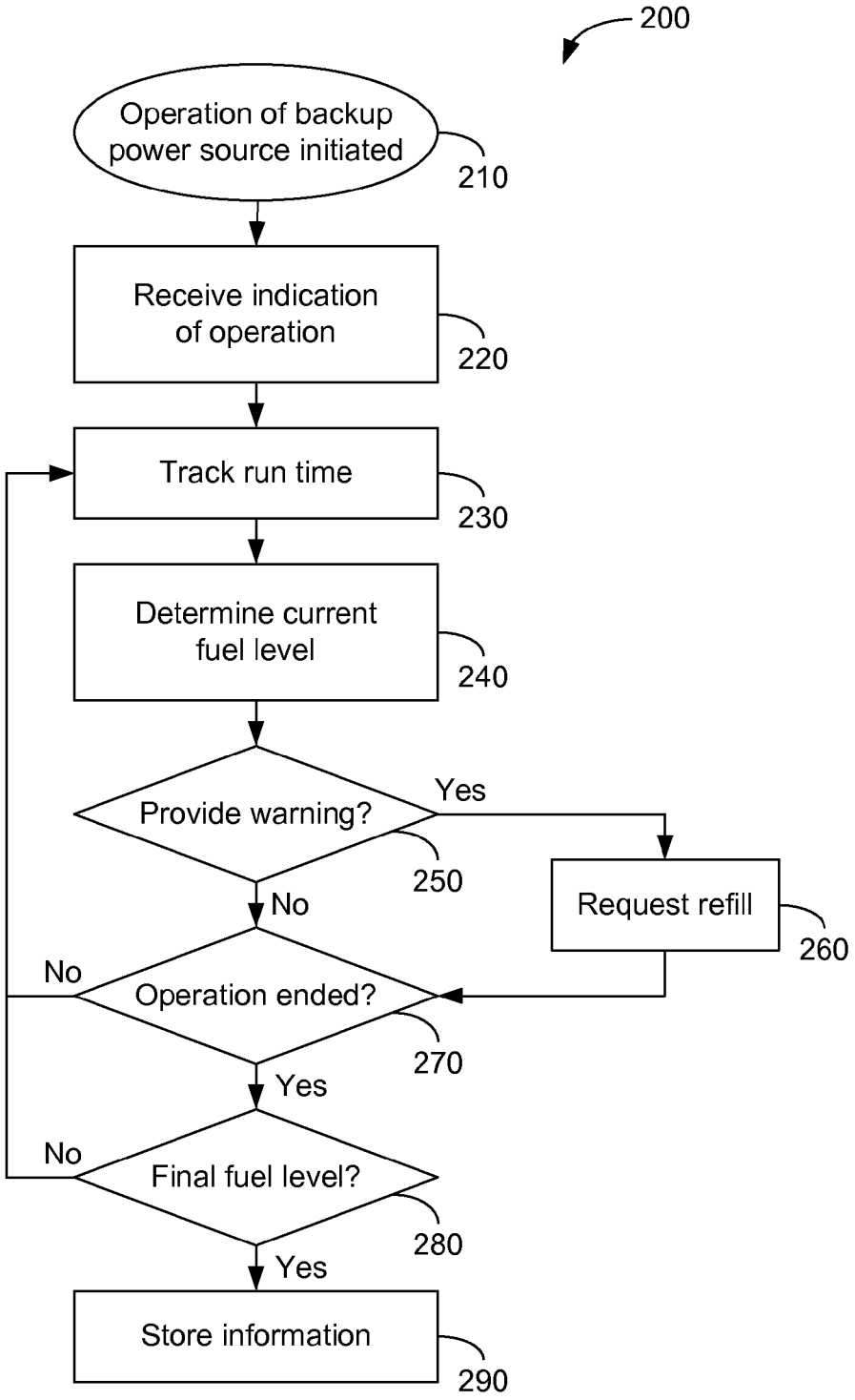
FIG. 2 is a flowchart illustrating functionality and operation of the supervisory system and/or the fuel monitoring system of FIG. 1 according to various embodiments of the present disclosure.

Referring now to FIG. 2, shown is a flowchart 200 illustrating functionality and operation of the supervisory system 160 and/or the fuel monitoring system 170 of FIG. 1 according to various embodiments of the present disclosure. When operation of the backup power source 110 is initiated in block 210, an indication of operation is provided by the local monitoring system 150. In some embodiments, the indication is a run alarm that is transmitted by the local monitoring system 150 to the supervisory system 160. The supervisory system 160 receives the indication in block 220, which initiates tracking of the run time of the backup power source 110 in block 230. The indication of operation may also initiate the fuel monitoring system 170. In alternative embodiments, the fuel monitoring system 170 may be initiated by a user request or based upon a predefined condition such as, but not limited to, a preset time of day. In some embodiments, a current run time is obtained by the fuel monitoring system 170 and used to determine the current fuel level in block 240. Determination of the current fuel level may be based, at least in part, upon the current run time and a starting fuel tank level of the fuel source 140 (FIG. 1). A run time capacity may also be determined and, in some embodiments, used to establish the current fuel level.

A fuel level warning may be provided in block 250 based upon a predefined fuel level threshold. For example, if the current fuel level is at and/or below the fuel level threshold, the fuel level warning is provided. If there is a fuel level warning, then a refill of the fuel source 140 is requested in block 260. In some embodiments, the refill request is automatically generated by the fuel monitoring system 170. In alternative embodiments, the refill request is generated in response to providing the fuel level warning to an operator of the supervisory system 160 or to another system that is used to generate the refill request. The refill request may then be sent to a vendor (e.g., as a hardcopy ticket or request, an e-mail, or another type of electronic message) for implementation. In general, only a single refill request is provided to avoid duplication of orders. However, in some cases, a subsequent refill order may be issued if the initial refill order was not fulfilled within a predefined delivery period. For example, if the initial refill order was not completed within one half of the remaining run time of the backup power source 110 at the time of issue, then a subsequent refill order may be provided. In alternative embodiments, one or more additional fuel level thresholds may be set that generate corresponding warnings and/or requests. For example, fuel level thresholds may be 40%, 25%, and 15% of a full tank. The 40% threshold may cause an initial fuel level warning to be produced in block 250 and a refill request to be processed in block 260; the 25% threshold may only produce a second fuel level warning in block 250; and the 15% threshold may produce a third fuel level warning in block 250 and a second refill request in block 260.

If no warning is provided, then it is determined in block 270 whether operation of the backup power source 110 has ceased. Similarly, if a refill request has been provided in block 260, then it is determined in block 270 whether operation of the backup power source 110 has stopped. The determination of block 270 may be based upon whether a stop indication (e.g., a shutdown alarm/notification or clearing of the run alarm) has been received from the local monitoring system 150. If operation of the backup power source 110 has not ended, then the system returns to block 230 where the current run time is updated. The determination and evaluation of the current fuel level (blocks 230-250) can be repeated on a periodic basis (e.g., every five minutes, ten minutes, or longer interval) until operation of the backup power source 270 ends in block 270. In some embodiments, a warning is provided only when the threshold condition is initially met during the current operation of the backup power source 110. In other embodiments, a new warning may be provided during each period based upon the updated current fuel level.

After operation of the backup power source 110 has terminated (block 270), then if the current fuel level is the final fuel level of the fuel source 140 at the termination of operation of the corresponding backup power supply 110, then the information is stored in block 290. The current run time and fuel level may be stored in the data store of the supervisory system 160. If the current fuel level is not the final fuel level of the fuel source 140, then the system returns to block 230 where the current run time is updated as the shut down time and evaluation of the current fuel level (blocks 230-280) is repeated. The final information is then stored in block 290 as discussed above.

A vendor fills the fuel source 140 in response to the fuel request. The vendor can determine the actual fuel level before refilling the fuel source 140 and a refilled tank level after refilling the fuel source 140. After a fuel source 140 is filled, the actual tank level before refilling and the refilled tank level is obtained by the supervisory system. For example, the levels may be obtained from the vendor billing. The current run time is reset to zero and the starting tank level is adjusted to match the refilled tank level. The fuel usage rate may also be adjusted based upon the current fuel level at the time of filling and the actual fuel level in the fuel source 140. For example, the fuel usage rate may be adjusted by the ratio of the current fuel level to the actual fuel level. In alternative embodiments, the actual fuel usage rate may be determined from the starting fuel level, the actual fuel level, and the current run time and used to adjust the fuel usage rate. The fuel usage rate may not be adjusted if the current fuel level is within a defined margin, range, or percentage of the actual fuel level. In some cases, the actual fuel level of the fuel source 140 may be obtained before a fuel level warning is provided. The fuel usage rate may be adjusted, as discussed above, based upon the actual fuel level and the current fuel level at the time the actual level was obtained.

In some implementations, the fuel monitoring system 170 may monitor the fuel condition for multiple backup power sources 110 at the same time. The fuel monitoring system 170 may be initiated in response to a user request or based upon other predefined conditions such as, but not limited to, a preset time each day or the expiration of a predefined time interval. The fuel monitoring system 170 may determine the current fuel level for one or more backup power sources 110. For example, the backup power sources 110 may be those units that are currently operating (e.g., as indicated by the "generator run" alarm sent by the local monitoring system 150 to the supervisory system 160) or those units that have operated since the previous initiation of the fuel monitoring system 170. In some embodiments, the backup power sources 110 include one or more units specified (or "flagged") to have their fuel tracked.

For each of the plurality of backup power sources 110, the fuel monitoring system 170 determines a current fuel level corresponding to a fuel source 140 associated with each of the backup power sources 110. The current fuel level may be obtained from a data store or by a determination based, at least in part, upon the current run time. Other information may also be determined such as, but not limited to, remaining run time. The determinations may be based upon information obtained from the fuel monitoring system 170 and/or from a data store. Fuel level warning(s) may be issued based upon the current fuel levels. In addition, refill requests may be initiated based upon the fuel level warning(s).

Figure 3:
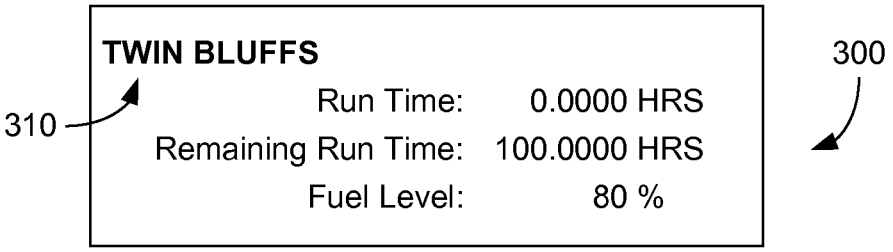
FIGS. 3-6 illustrate various graphical representations and/or reports of status information that may be generated by the supervisory system and/or the fuel monitoring system of FIG. 1 according to various embodiments of the present disclosure.

Various graphical representations and/or reports may also be generated by the supervisory system 160 and/or the fuel monitoring system 170 based upon the current and/or historical information corresponding to one or more backup power sources 110. The graphical representations may be based upon information obtained from the fuel monitoring system 170 and/or from a data store. The graphical representations and/or reports may be provided for rendering on a display device or for printing as a hard copy. Referring now to FIG. 3, shown is a simple graphical representation 300 providing status information (e.g., current run time, remaining run time, and current fuel level) corresponding to a backup power source 310 identified as the Twin Bluffs unit. Other status information such as, but not limited to, current run time, current start time, and previous stop time may also be displayed in the graphical representation 300 of FIG. 3.

Figure 4:
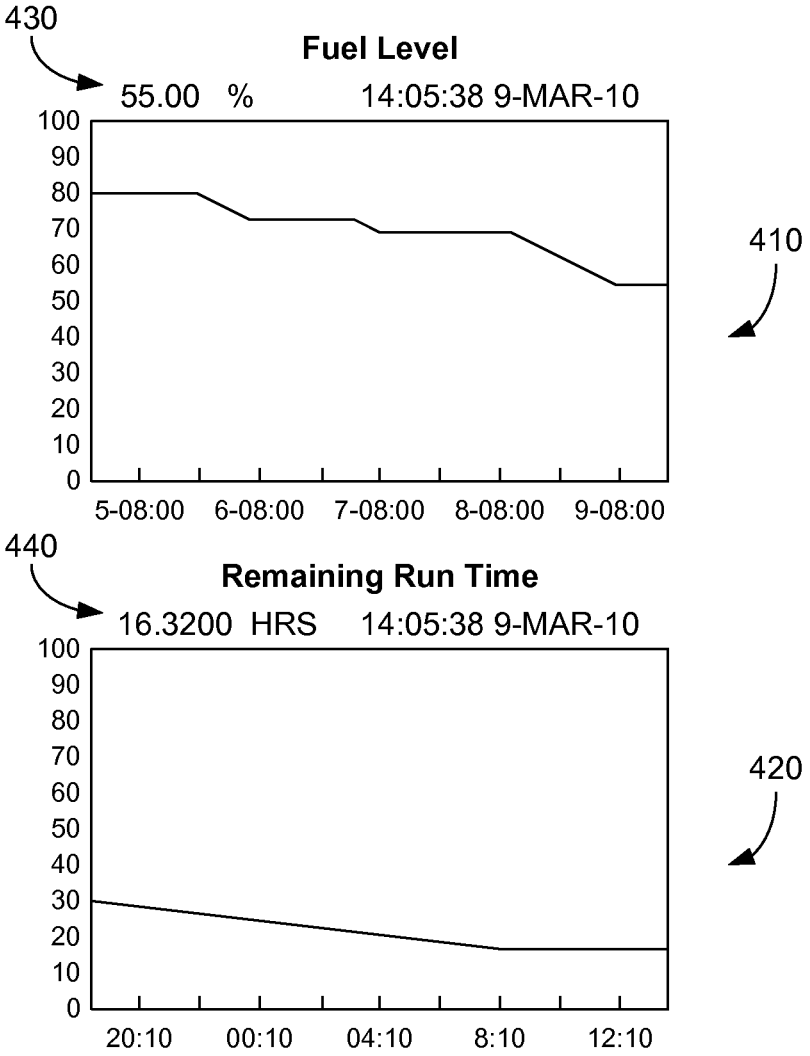

Time trending information such as the plots illustrated in FIG. 4 may also be generated by the supervisory system 160 and/or the fuel monitoring system 170. The fuel level plot 410 and the remaining run time plot can be produced from the current and historical information stored in the data store. In the embodiment of FIG. 4, the fuel level over the previous five days is displayed in plot 410 with the current fuel level 430 and current time indicated at the top of the plot 410. The remaining run time over the previous twenty hours is displayed in plot 420 with the remaining run time 440 at the indicated time at the top of the plot 410. As can be understood, different scaling and time periods may be utilized.

Figures 5, 6:
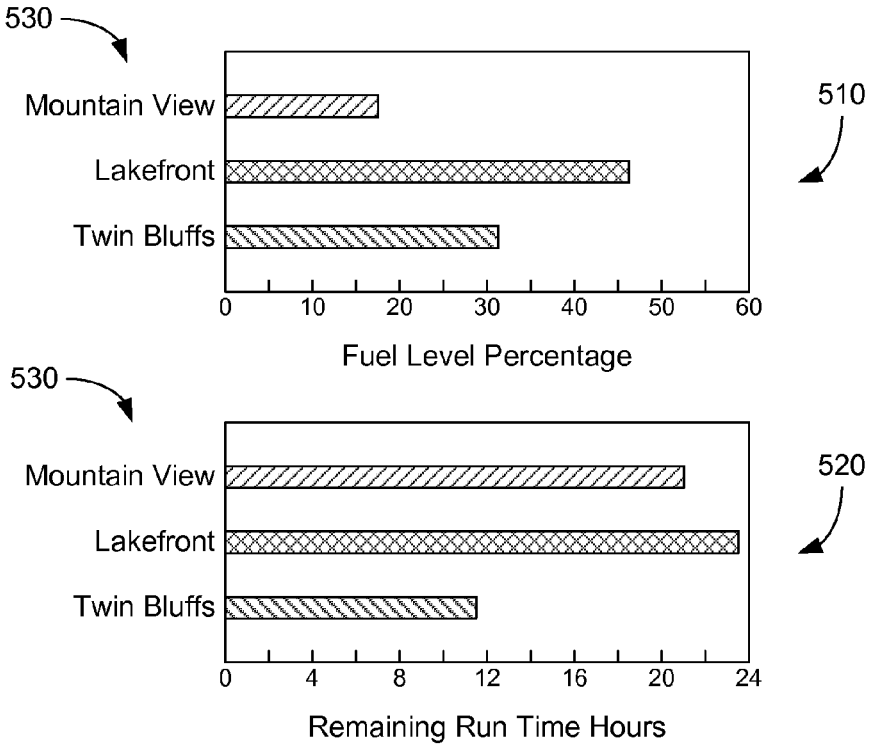

Status information (e.g., current fuel level and remaining run time) for one or more backup power sources 110 may also be graphically represented as bar charts or pie graphs. FIG. 5 illustrates a bar graph 510 for current fuel level and a bar graph 520 for remaining run time corresponding to three backup power sources 530 identified as the Mountain View, Lakefront, and Twin Bluffs units. In some embodiments, the displayed backup power sources 530 may be limited based upon defined conditions. For example, the displayed backup power sources 530 may include only those units with less than a 50% fuel level or only those units with less than 24 hours of remaining run time. The graphical representations may be stored in the data store of the supervisory system 160 for later retrieval and/or rendering.

Reports may also be generated by the supervisory system 160 and/or the fuel monitoring system 170. FIG. 6 depicts a portion of an example report 600 including status information of a plurality of backup power sources 110 in a spreadsheet format. Other formats may also be utilized. The report 600 can include identification and current status information such as current fuel level and remaining run time, as well as other information including, but not limited to, the state of the backup power source 110, identification of the fuel source 140, the last stop and start times, and the time of the last adjustment to the fuel usage rate. The report 600 may also include graphical representations such as those depicted in FIGS. 3-5. In some embodiments, the report 600 may be generated upon request by a user of the supervisory system 160. In other embodiments, the report 600 may be generated at predefined times or intervals during the day and stored in the data store for later access and/or rendering. The reports may be stored in the data store of the supervisory system 160 for later retrieval.

Figure 7:
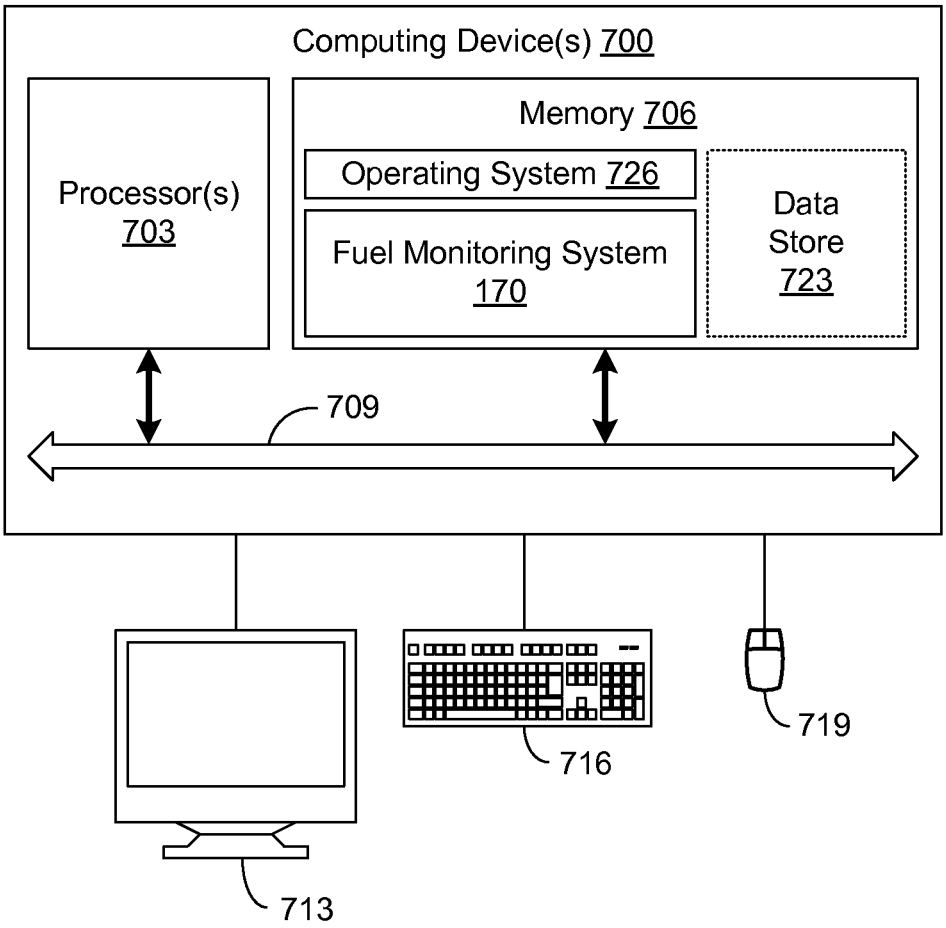
FIG. 7 is a schematic block diagram of a computing device included in the supervisory system of FIG. 1 according to various embodiments of the present disclosure.

With reference to FIG. 7, shown is a schematic block diagram of a computing device 700 included in the supervisory system 160 of FIG. 1 according to various embodiments of the present disclosure. The computing device 700 includes at least one processor circuit, for example, having a processor 703 and a memory 706, both of which are coupled to a local interface 709. To this end, the computing device 700 may comprise, for example, at least one server computer or like device. The local interface 709 may comprise, for example, a data bus with an accompanying address/control bus or other bus structure as can be appreciated. Coupled to the computing device 700 are various peripheral devices such as, for example, a display device 713, a keyboard 716, a mouse 719, a scanner, a printer, etc.

Stored in the memory 706 are both data and several components that are executable by the processor 703. In particular, stored in the memory 706 and executable by the processor 703 are the fuel monitoring system 170 and potentially other applications. Also stored in the memory 706 may be a data store 723 and other data. In addition, an operating system 726 may be stored in the memory 706 and executable by the processor 703.

It is understood that there may be other applications that are stored in the memory 706 and are executable by the processors 703 as can be appreciated. Where any component discussed herein is implemented in the form of software, any one of a number of programming languages may be employed such as, for example, C, C++, C#, Objective C, Java, Java Script, Perl, PHP, Visual Basic, Python, Ruby, Delphi, Flash, or other programming languages.

A number of software components are stored in the memory 706 and are executable by the processor 703. In this respect, the term "executable" means a program file that is in a form that can ultimately be run by the processor 703. Examples of executable programs may be, for example, a compiled program that can be translated into machine code in a format that can be loaded into a random access portion of the memory 706 and run by the processor 703, source code that may be expressed in proper format such as object code that is capable of being loaded into a random access portion of the memory 706 and executed by the processor 703, or source code that may be interpreted by another executable program to generate instructions in a random access portion of the memory 706 to be executed by the processor 703, etc. An executable program may be stored in any portion or component of the memory 706 including, for example, random access memory (RAM), read-only memory (ROM), hard drive, solid-state drive, USB flash drive, memory card, optical disc such as compact disc (CD) or digital versatile disc (DVD), floppy disk, magnetic tape, or other memory components.

The memory 706 is defined herein as including both volatile and nonvolatile memory and data storage components. Volatile components are those that do not retain data values upon loss of power. Nonvolatile components are those that retain data upon a loss of power. Thus, the memory 706 may comprise, for example, random access memory (RAM), read-only memory (ROM), hard disk drives, solid-state drives, USB flash drives, memory cards accessed via a memory card reader, floppy disks accessed via an associated floppy disk drive, optical discs accessed via an optical disc drive, magnetic tapes accessed via an appropriate tape drive, and/or other memory components, or a combination of any two or more of these memory components. In addition, the RAM may comprise, for example, static random access memory (SRAM), dynamic random access memory (DRAM), or magnetic random access memory (MRAM) and other such devices. The ROM may comprise, for example, a programmable read-only memory (PROM), an erasable programmable read-only memory (EPROM), an electrically erasable programmable read-only memory (EEPROM), or other like memory device.

Also, the processor 703 may represent multiple processors 703 and the memory 706 may represent multiple memories 706 that operate in parallel processing circuits, respectively. In such a case, the local interface 709 may be an appropriate network that facilitates communication between any two of the multiple processors 703, between any processor 703 and any of the memories 706, or between any two of the memories 706, etc. The local interface 709 may comprise additional systems designed to coordinate this communication, including, for example, performing load balancing. The processor 703 may be of electrical or of some other available construction.

Although the fuel monitoring system 170 and other various systems described herein may be embodied in software or code executed by general purpose hardware as discussed above, as an alternative the same may also be embodied in dedicated hardware or a combination of software/general purpose hardware and dedicated hardware. If embodied in dedicated hardware, each can be implemented as a circuit or state machine that employs any one of or a combination of a number of technologies. These technologies may include, but are not limited to, discrete logic circuits having logic gates for implementing various logic functions upon an application of one or more data signals, application specific integrated circuits having appropriate logic gates, or other components, etc. Such technologies are generally well known by those skilled in the art and, consequently, are not described in detail herein.

The flowchart 200 of FIG. 2 shows functionality and operation of an implementation of portions of a supervisory system 160 and/or a fuel monitoring system 170. If embodied in software, each block may represent a module, segment, or portion of code that comprises program instructions to implement the specified logical function(s). The program instructions may be embodied in the form of source code that comprises human-readable statements written in a programming language or machine code that comprises numerical instructions recognizable by a suitable execution system such as a processor 803 in a computer system or other system. The machine code may be converted from the source code, etc. If embodied in hardware, each block may represent a circuit or a number of interconnected circuits to implement the specified logical function(s).

Although the flowchart 200 of FIG. 2 shows a specific order of execution, it is understood that the order of execution may differ from that which is depicted. For example, the order of execution of two or more blocks may be scrambled relative to the order shown. Also, two or more blocks shown in succession in FIG. 2 may be executed concurrently or with partial concurrence. Further, in some embodiments, one or more of the blocks shown in FIG. 2 may be skipped or omitted. In addition, any number of counters, state variables, warning semaphores, or messages might be added to the logical flow described herein, for purposes of enhanced utility, accounting, performance measurement, or providing troubleshooting aids, etc. It is understood that all such variations are within the scope of the present disclosure.

Also, any logic or application described herein, including the fuel monitoring system 170 that comprises software or code can be embodied in any non-transitory, tangible computer-readable medium for use by or in connection with an instruction execution system such as, for example, a processor 703 in a computer system or other system. In this sense, the logic may comprise, for example, statements including instructions and declarations that can be fetched from the computer-readable medium and executed by the instruction execution system. In the context of the present disclosure, a "computer-readable medium" can be any medium that can contain, store, or maintain the logic or application described herein for use by or in connection with the instruction execution system. The computer-readable medium can comprise any one of many physical media such as, for example, electronic, magnetic, optical, electromagnetic, infrared, or semiconductor media. More specific examples of a suitable computer-readable medium would include, but are not limited to, magnetic tapes, magnetic floppy diskettes, magnetic hard drives, memory cards, solid-state drives, USB flash drives, or optical discs. Also, the computer-readable medium may be a random access memory (RAM) including, for example, static random access memory (SRAM) and dynamic random access memory (DRAM), or magnetic random access memory (MRAM). In addition, the computer-readable medium may be a read-only memory (ROM), a programmable read-only memory (PROM), an erasable programmable read-only memory (EPROM), an electrically erasable programmable read-only memory (EEPROM), or other type of memory device.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, at least the following is claimed:

1. A fuel usage monitoring system comprising:

at least one computing device; and a fuel monitoring system executable in the at least one computing device, the fuel monitoring system operable to:

obtain a current run time corresponding to a period of past operation of a backup power source;

determine a current fuel level based at least in part upon the current run time and a starting fuel source level, the current fuel level corresponding to a fuel tank supplying the backup power source; and provide a fuel level warning based upon the current fuel level and a predefined fuel level threshold.

2. The fuel usage monitoring system of claim 1, wherein a fuel tank refill request is submitted to a fuel supplier in response to the fuel level warning.

3. The fuel usage monitoring system of claim 2, wherein the fuel monitoring system is further operable to generate the fuel tank refill request.

4. The fuel usage monitoring system of claim 1, wherein the fuel monitoring system repeats the determination of the current fuel level on a periodic basis.

5. The fuel usage monitoring system of claim 1, wherein execution of the fuel monitoring system is initiated in response to an indication of initiation of backup power source operation.

6. The fuel usage monitoring system of claim 5, wherein the indication is a run alarm transmitted by the backup power source.

7. The fuel usage monitoring system of claim 1, wherein the determination of the current fuel level is further based at least in part upon a run time capacity associated with the fuel tank and the backup power source.

8. The fuel usage monitoring system of claim 7, wherein the run time capacity is based upon a capacity of the fuel tank and a fuel usage rate of the backup power source when operating at a fixed load level.

9. The fuel usage monitoring system of claim 8, wherein the fuel usage rate is based upon manufacturer data for the backup power source.

10. The fuel usage monitoring system of claim 8, wherein the run time capacity is adjusted based upon the current fuel level and an actual fuel level of the fuel tank corresponding to the current fuel level.

11. The fuel usage monitoring system of claim 7, wherein the fuel monitoring system is further operable to determine a remaining run time associated with the backup power source.

12. The fuel usage monitoring system of claim 1, wherein the fuel monitoring system monitors a plurality of backup power sources.

13. The fuel usage monitoring system of claim 12, wherein the fuel monitoring system is further operable to provide a fuel monitor report based upon a plurality of current fuel levels, each of the plurality of current fuel levels corresponding to one of the plurality of backup power sources.

14. A method for monitoring fuel usage of a backup power source, the method comprising:

tracking an accumulated run time of the backup power source;

determining a current fuel level associated with the backup power source based at least in part upon the accumulated run time; and providing a fuel level warning based upon the current fuel level and a predefined fuel level threshold.

15. The method of claim 14, wherein the accumulated run time is tracked during operation of the backup power source.

16. The method of claim 15, wherein the current fuel level is periodically updated, based at least in part upon the accumulated run time, during operation of the backup power source.

17. The method of claim 15, wherein the current fuel level is updated, based at least in part upon the accumulated run time, upon cessation of operation of the backup power source.

18. The method of claim 14, further comprising providing a graphical representation of the current fuel level for rendering on a display device.

19. The method of claim 14, further comprising determining a remaining run time associated with the backup power source.

20. The method of claim 19, further comprising providing a graphical representation of the remaining run time for rendering on a display device.

* * * * *